US006069783A

United States Patent [19]

Mount et al.

[11] Patent Number: 6,069,783

[45] Date of Patent: May 30, 2000

[54] APPARATUS AND METHOD FOR CONTROLLING A SOLENOID VALVE

[75] Inventors: Mason B. Mount, Mansfield; John R. Hart, Jr., Lexington, both of Ohio

[73] Assignee: Hi-Stat Manufacturing Company, Inc., Sarasota, Fla.

[21] Appl. No.: 09/187,602

[22] Filed: Nov. 6, 1998

[51] Int. Cl.[7] ..... H01H 9/00

[52] U.S. Cl. ..... 361/154; 361/160; 361/170; 123/490

[58] Field of Search ..... 361/154, 160, 361/170, 187; 123/490

[56] References Cited

U.S. PATENT DOCUMENTS

| | | | |
|---|---|---|---|
| 3,874,407 | 4/1975 | Griswold | 137/596.17 |
| 4,539,967 | 9/1985 | Nakajima et al. | 123/585 |
| 4,677,956 | 7/1987 | Hamburg | 123/520 |
| 4,821,701 | 4/1989 | Nankee, II et al. | 123/520 |
| 4,825,333 | 4/1989 | Clive et al. | 361/154 |
| 4,898,361 | 2/1990 | Bender et al. | 251/129.05 |
| 5,183,022 | 2/1993 | Cook | 123/520 |
| 5,202,813 | 4/1993 | Uota et al. | 361/154 |
| 5,237,980 | 8/1993 | Gillier | 123/520 |
| 5,263,460 | 11/1993 | Baxter et al. | 123/520 |
| 5,323,751 | 6/1994 | Osanai | 123/520 |
| 5,326,070 | 7/1994 | Baron | 251/129.15 |
| 5,351,193 | 9/1994 | Poirier et al. | 364/431.01 |
| 5,368,002 | 11/1994 | Hoshino et al. | 123/520 |
| 5,445,132 | 8/1995 | Isobe et al. | 123/520 |
| 5,535,725 | 7/1996 | Baker et al. | 123/520 |
| 5,551,406 | 9/1996 | Everingham et al. | 123/520 |
| 5,609,142 | 3/1997 | Osanai | 123/520 |
| 5,682,869 | 11/1997 | Nankee, II et al. | 123/698 |
| 5,696,317 | 12/1997 | Rychlick | 73/118.1 |
| 5,703,750 | 12/1997 | Kin et al. | 361/187 |
| 5,941,216 | 8/1999 | Arakawa | 123/490 |

*Primary Examiner*—Michael J. Sherry
*Attorney, Agent, or Firm*—Bliss McGlynn, P.C.

[57] ABSTRACT

An apparatus and method for controlling a solenoid valve wherein the flow rate of the valve relative to a specific percent duty cycle may be varied. The controller is such that after the desired flow of the solenoid valve is determined, the frequency and percent duty cycle of an output signal controlling the solenoid valve is varied. Such a controller utilizes varying frequencies to provide multiple slope flow rates with a single passage solenoid valve.

27 Claims, 4 Drawing Sheets

| INPUT | OUTPUT | |
|---|---|---|
| % DUTY CYCLE | FREQ. | % DUTY CYCLE |
| 0 | 8 | 0 |
| 1 | 8 | 1 |
| 2 | 8 | 2 |
| 3 | 8 | 3 |
| 4 | 8 | 4 |
| 5 | 8 | 5 |
| 6 | 8 | 6 |
| 7 | 8 | 7 |
| 8 | 8 | 8 |
| 9 | 8 | 9 |
| 10 | 8 | 10 |
| 11 | 8.48 | 11 |
| 12 | 8.96 | 12 |
| 13 | 9.44 | 13 |
| 14 | 9.92 | 14 |
| 15 | 10.4 | 15 |
| 16 | 10.88 | 16 |
| 17 | 11.36 | 17 |
| 18 | 11.84 | 18 |
| 19 | 12.32 | 19 |
| 20 | 12.8 | 20 |
| 21 | 13.28 | 21 |
| 22 | 13.76 | 22 |
| 23 | 14.24 | 23 |
| 24 | 14.72 | 24 |
| 25 | 15.2 | 25 |
| 26 | 15.68 | 26 |
| 27 | 16.16 | 27 |
| 28 | 16.64 | 28 |
| 29 | 17.12 | 29 |
| 30 | 17.6 | 30 |
| 31 | 18.08 | 31 |
| 32 | 18.56 | 32 |
| 33 | 19.04 | 33 |
| 34 | 19.52 | 34 |
| 35 | 20 | 35 |
| 36 | 20.48 | 36 |
| 37 | 20.96 | 37 |
| 38 | 21.44 | 38 |
| 39 | 21.92 | 39 |
| 40 | 22.4 | 40 |
| 41 | 22.88 | 41 |
| 42 | 23.36 | 42 |
| 43 | 23.84 | 43 |
| 44 | 24.32 | 44 |
| 45 | 24.8 | 45 |
| 46 | 25.28 | 46 |
| 47 | 25.76 | 47 |
| 48 | 26.24 | 48 |
| 49 | 26.72 | 49 |
| 50 | 27.2 | 50 |

| INPUT | OUTPUT | |
|---|---|---|
| % DUTY CYCLE | FREQ. | % DUTY CYCLE |
| 51 | 27.68 | 51 |
| 52 | 28.16 | 52 |
| 53 | 28.64 | 53 |
| 54 | 29.12 | 54 |
| 55 | 29.6 | 55 |
| 56 | 30.08 | 56 |
| 57 | 30.56 | 57 |
| 58 | 31.04 | 58 |
| 59 | 31.52 | 59 |
| 60 | 32 | 60 |
| 61 | 31.4 | 61 |
| 62 | 30.8 | 62 |
| 63 | 30.2 | 63 |
| 64 | 29.6 | 64 |
| 65 | 29 | 65 |
| 66 | 28.4 | 66 |
| 67 | 27.8 | 67 |
| 68 | 27.2 | 68 |
| 69 | 26.6 | 69 |
| 70 | 26 | 70 |
| 71 | 25.4 | 71 |
| 72 | 24.8 | 72 |
| 73 | 24.2 | 73 |
| 74 | 23.6 | 74 |
| 75 | 23 | 75 |
| 76 | 22.4 | 76 |
| 77 | 21.8 | 77 |
| 78 | 21.2 | 78 |
| 79 | 20.6 | 79 |
| 80 | 20 | 80 |
| 81 | 19.4 | 81 |
| 82 | 18.8 | 82 |
| 83 | 18.2 | 83 |
| 84 | 17.6 | 84 |
| 85 | 17 | 85 |
| 86 | 16.4 | 86 |
| 87 | 15.8 | 87 |
| 88 | 15.2 | 88 |
| 89 | 14.6 | 89 |
| 90 | 14 | 90 |
| 91 | 13.4 | 91 |
| 92 | 12.8 | 92 |
| 93 | 12.2 | 93 |
| 94 | 11.6 | 94 |
| 95 | 11 | 95 |
| 96 | 10.4 | 96 |
| 97 | 9.8 | 97 |
| 98 | 9.2 | 98 |
| 99 | 8.6 | 99 |
| 100 | 8 | 100 |

Fig–7

APPARATUS AND METHOD FOR CONTROLLING A SOLENOID VALVE

BACKGROUND OF THE INVENTION

1. Field of the Invention

The present invention relates generally to a solenoid valve. More specifically, the present invention relates to a method and apparatus for controlling the solenoid valve to achieve a desired flow rate.

2. Description of the Related Art

Solenoid valves are used in a multitude of various operations. One use is the automotive industry wherein a solenoid valve is used in conjunction with a vapor canister in a vehicle emission system. For instance, under normal operating conditions, fuel vapors from the vehicle's fuel tank are stored in the vapor canister. The canister is purged by drawing fresh air through the canister into the intake manifold of the engine. Purging the canister disrupts optimum air-fuel ratio and may result in inefficient operation of the engine. Thus, a solenoid valve is used to control the flow rate of fuel vapor being drawn from the vapor canister into the intake manifold.

Modern engines are tightly tuned for optimum operating performance. The amount of canister purge vapor entering the intake manifold is controlled by the solenoid. The solenoid valve is turned on and off or cycled based on various operating parameters. The duty cycle or percentage of time that the solenoid valve is open regulates the flow of fuel vapors being purged from the canister.

Various types of control systems to control or regulate the desired flow of fuel vapor from the vapor canister are known. One type of system controls operation of the solenoid valve through a duty cycle pulse width modulation. Duty cycle pulse width modulation control systems use from 5 to 100 percent of the duty cycle to vary the flow. Such systems fail to provide the flexibility necessary to control and, more specifically, regulate flow at both the low and high ends of the duty cycle. For instance, the slope of the flow rate versus percent duty cycle for optimum low end control may not be suitable for high end flow and vice versa.

Thus, it is advisable to have a control system which provides optimum flow control characteristics throughout the entire range of the duty cycle. For instance, the flow rate may be modified independently of the duty cycle wherein the overall slope of the flow rate with respect to the duty cycle may change for various percentages of duty cycle.

Another type of control system uses a current signal to actuate an armature so that flow is proportional to current. These control systems tend to have more hysteresis and are not useful for the initial 25 percent of the full scale signal.

SUMMARY OF THE INVENTION

Accordingly, the present invention provides an apparatus and method for controlling a solenoid valve. The apparatus and method are such that the flow rate of the solenoid valve relative to a specific percent duty cycle may be varied. The method for controlling the solenoid to obtain a desired flow rate includes the steps of receiving a signal representing a desired solenoid flow rate and generating an output signal having a frequency component and a percent duty cycle component. The output signal is based on the desired flow rate and is formed by varying the frequency component with the percent duty cycle component. The output signal is used to control operation of the solenoid.

The method for controlling the flow rate may also include the steps of: generating or receiving an input signal representing a set or predetermined percent duty signal based upon various parameters sensed by engine operating sensors; determining the pulse width of the input signal and creating an input voltage corresponding to the pulse width; establishing a reference voltage comparing the input voltage to the reference voltage and generating a logic output based on the comparison; generating an output frequency based upon the logic output; and combining the input signal representing a predetermined percent duty cycle with the output frequency to generate an output signal and driving the solenoid in accordance with the output signal.

Accordingly, the present invention also provides a control apparatus for controlling flow through a solenoid valve. The apparatus includes an integrator receiving a signal corresponding to a particular duty cycle. The integrator generates an output voltage proportional to the width of the pulse at a particular voltage. A comparator receives the output voltage from the integrator, compares it to a reference voltage and generates an output signal based on the comparison. A signal conditioner receives the comparator output signal and generates a signal conditioner output signal either proportional or inversely proportional to the output voltage generated by the integrator. An astable oscillator receives the signal conditioner output signal and generates an oscillator output having a frequency based on the signal conditioner output signal. A monostable oscillator receives the oscillator output frequency and combines the duty cycle from the initial signal with the oscillator output frequency. The output of the monostable oscillator then drives the solenoid. Thus, for various duty cycles, the output frequency can be varied.

Other features and advantages of the present invention will be readily appreciated as the same becomes better understood after reading the subsequent description taken in conjunction with the accompanying drawings.

BRIEF DESCRIPTION OF THE DRAWINGS

FIG. 7 illustrates an example of a look-up chart for use in determining an output frequency.

DETAILED DESCRIPTION OF THE PREFERRED EMBODIMENT(S)

Figure 1:
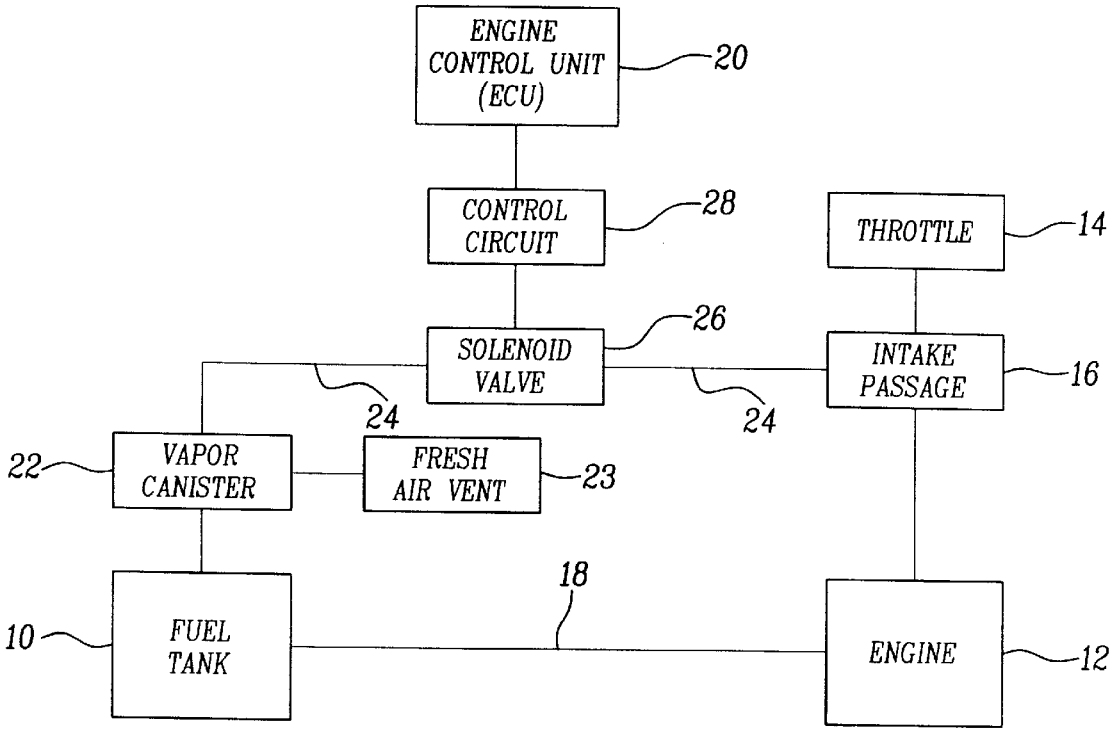
FIG. 1 is a schematic view of an apparatus for controlling the operation of a fuel vapor purge system according to an embodiment of the invention.

Turning to FIG. 1, automotive fuel systems typically include a fuel tank 10 for use with an engine 12. A throttle valve 14 adjacent an intake passage 16 controls the amount of intake air supplied to the engine 12. Fuel is correspondingly supplied to the engine 12 through a fuel line 18 extending between the fuel tank 10 and the engine 12.

During engine operation, a proper amount of fuel and air are supplied to the engine 12 to achieve the proper stoichiometric ratio for efficient combustion. Fuel and air amounts are typically controlled through an engine control unit (ECU) 20. Fuel vapors formed in the fuel tank 10 during operation of the engine 12 and also during refueling are stored in a vapor canister 22. A fresh air vent is connected to the vapor canister 22. A purge line 24 connects the vapor canister 22 to the intake passage 16. Under predetermined operating conditions, the fuel vapor stored in the vapor canister 22 is purged or drawn into the intake passage 16. During engine operation, the intake passage 16 operates at a negative pressure, thus the fuel vapors stored in the vapor canister 22 are drawn into the intake passage 16. Flow from the vapor canister 22 to the intake passage 16 is typically controlled by a solenoid valve 26. The solenoid valve 26 is positioned in the purge line 24 and is connected to and receives a signal from the ECU 20. Upon reaching the predetermined operating conditions, the ECU 20 sends a signal to open the solenoid valve 26 thereby allowing the purging process to take place.

Figure 2:
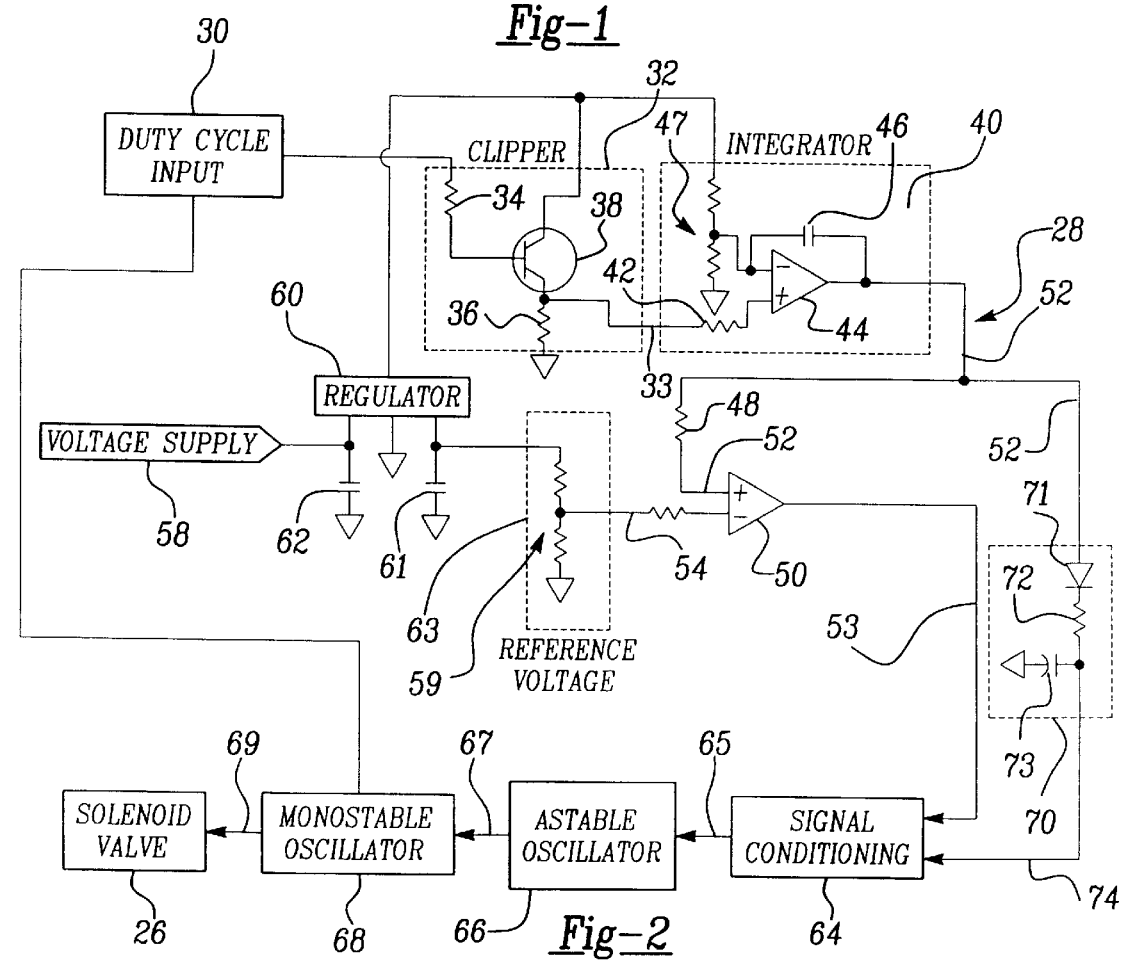
FIG. 2 is a schematic of a control circuit of FIG. 1.

FIG. 2 shows a schematic of a control circuit 28 to control operation of the solenoid valve 26. During the purging process, it is desirable to control the flow of the fuel vapor from the vapor canister 22. This can be accomplished in several ways, one of which is controlling the solenoid valve 26 by changing or varying the duty cycle of the actuation signal applied to the solenoid valve 26. Variations or changes in the duty cycle vary or change the flow rate of fuel vapor through the solenoid valve 26. The flow rate of fuel vapor from the vapor canister 22 to the intake passage 16 varies based on a variety of engine operating parameters, including engine RPM, throttle position sensor, fuel injection rate, ignition timing, exhaust gas sensor, fuel air ratio sensor, appropriate stoichiometric amounts and other parameters that may be monitored or determined that affect engine operating performance.

The present invention is directed to a control circuit for controlling the solenoid valve 26 to vary the flow rate of fuel vapors from the vapor canister 22. FIG. 2 schematically illustrates the components of the control circuit 28. Initially, an input duty cycle 30 is received from the ECU 20. While the input discussed in the preferred embodiment is the duty cycle 30, the input could also be any input indicative of the desired flow rate. Thus, the ECU 20 can provide as an output the desired flow rate based on the operating parameters set forth above.

The duty cycle input 30 is typically a percentage of the overall flow rate of the solenoid valve 26 and represents the desired flow rate. The percent duty cycle is normally the percentage of on time versus off time for each cycle. In determining the percent duty cycle at which the solenoid valve 26 will operate, it is desired to have smooth, continuous fuel vapor flow and to eliminate any pulsing of fuel vapors flowing from the vapor canister 22. As shown, depending upon the specific engine parameters, the ECU 20 sends a signal indicative of the particular percent duty cycle to control operation of the solenoid valve 26. This signal is received by the control circuit 28 at duty cycle input 30. The duty cycle input 30 is typically a unipolar DC pulse train formed from an unregulated voltage source, normally 12 volt DC. The wave form of the DC pulse train has a variable duty cycle and a peak voltage that may vary from 9 to 15 volts DC. Initially, the input signal passes through a clipper 32, including a first resistor 34, a second resistor 36 and a transistor 38. The clipper 32 operates to clip the upper voltage from the wave form. Removing the upper portion of the wave allows the energy below the peak to be independent of the voltage supply and peak voltage variations. In short, it makes the peak voltage predictable. The output signal 33 from the clipper 32 is then input into an integrator circuit 40 including a third resistor 42, an amplifier 44, a capacitor 46 and a voltage divider circuit, seen generally at 47. The integrator 40 integrates the output signal 33 of the clipper 32 to produce a DC voltage level that is directly proportional to the pulse width at the clipped voltage. As the on time of the pulse becomes longer, the output DC voltage level of the integrator 40 becomes larger. Thus, as the duty cycle increases, the peak DC voltage level output as integrator output signal 52, increases. The integrator output signal 52 forms a sawtooth wave wherein the primary concern is the peak voltage. The integrator output signal 52 of the integrator 40 travels through a fourth resistor 48 and enters a comparator 50. The comparator 50 compares the voltage of the integrator output signal 52 from the integrator 40 with a reference voltage 54. Based on the comparison, the comparator 50 generates a comparator output 53, either a logic 0 or a logic 1. If the reference voltage 54 is higher than the voltage of the integrator output signal 52, then a logic 0 is supplied as the comparator output 53. If the reference voltage 54 is less than the voltage of the integrator output signal 52, then the comparator output 53 is supplied as a logic 1.

The reference voltage 54 is typically supplied by a voltage supply 58 that also supplies the voltage necessary for the components of the control circuit 28 to operate. The voltage supply 58 is usually the vehicle battery when the control circuit 28 is used with purge control systems. The voltage supply 58 is passed through a regulator 60 including a pair of capacitors 61, 62. If the supply voltage supplied to the ECU 20 is already regulated at a voltage level typically used for automotive electronic circuits, then further regulation would not be needed. For instance, if the supply voltage is already regulated at 5 volts DC, only additional filtering and coupling is necessary. If, however, the supply voltage is from a 12 volt battery, then it becomes necessary to regulate the voltage to a chosen operating voltage, here we have selected 5 volts DC. The regulated voltage is input into a reference voltage 63, including a voltage divider circuit, seen generally at 59, which generates the reference voltage 54. As set forth previously, the reference voltage 54 is used as one input into the comparator 50. The reference voltage 54 is set at a value equal to a DC voltage level generated by the integrator 40 when the duty cycle input 30 is at a 60% percent duty cycle. This percentage duty cycle is subject to change as an operating parameter set by the operator relative to desired flow parameters.

A peak detector 70, including a diode 71, a resistor 72 and a capacitor 73 store energy from the waveform of the integrator output signal 52. The peak detector 70 has a high output impedance so that energy in is greater than the energy out. Thus, the voltage output 74 from the peak detector 70 approaches the peak input voltage of the integrator output signal 52.

A signal conditioning circuit 64 receives both the comparator output 53 from the comparator 50 and the voltage output 74 from the peak detector 70. The signal conditioning circuit 64 generates a conditioned output signal 65 based on the voltage output 74 of the peak detector 70 and the comparator output 53 of the comparator 50. The signal conditioning circuit 64 works on a dual slope approach wherein the voltage level of conditioned output signal 65 of the signal conditioning circuit 64 is proportionate to the received voltage output 74 when the comparator output 53 is at a logic 0. However, when the comparator output 53 from the comparator 50 is at a logic 1, the voltage level of the conditioned output signal 65 of the signal conditioning circuit 64 is decreased when the voltage output 74 of the peak detector 70 is increased. The conditioned output signal 65 of the signal conditioning circuit 64 is received by an astable oscillator 66 which produces a frequency proportional to the DC voltage level of the conditioned output signal 65 supplied by the signal conditioning circuit 64. The oscillator frequency output 67 from the astable oscillator 66 is input into a monostable oscillator 68 which marries the duty cycle of the initial input duty cycle 30 to the oscillator frequency output 67 generated by the astable oscillator 66. The monostable oscillator 68 utilizes a fixed resistance/capacitant circuit with a variable charge voltage to change the time required for the capacitor voltage to become larger than a stable reference voltage. The output 69 of the monostable oscillator 68 controls operation of the solenoid valve 26.

Figure 3:
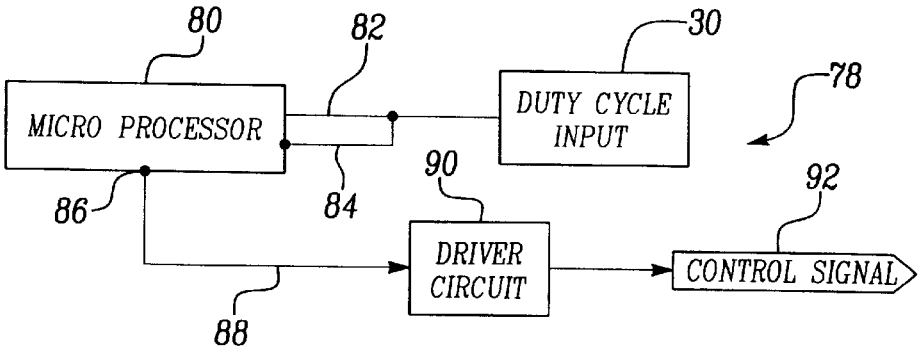
FIG. 3 is a schematic of a method for controlling the operation of a fuel vapor purge system according to a further embodiment of the invention.

The apparatus may also be controlled via software. Turning to FIG. 3, a schematic diagram illustrating a software control system 78 is shown. The control system 78 includes a control unit, shown as a microprocessor 80, receiving the duty cycle input 30 generated by the ECU 20. While the control unit is shown as a microprocessor, a microcontroller could also be used. As set forth previously, the duty cycle input 30 represents either the duty cycle generated in response to the various operating parameters of the engine 12 or may be sent as a flow requirement to which the microprocessor 80 assigns both percent duty cycle and frequency. As shown in FIG. 3, the duty cycle input 30 is split into first and second input signals 82, 84, each of which is received in the microprocessor 80. As set forth more fully below, the microprocessor 80 based on the duty cycle input 30 generates an output signal at output pin 86. The output signal 88 generated at the output pin 86 is received by a driver circuit 90 which boosts the output signal 88 from output pin 86 to provide a control signal 92 used to control operation of the solenoid valve 26.

Figure 4:
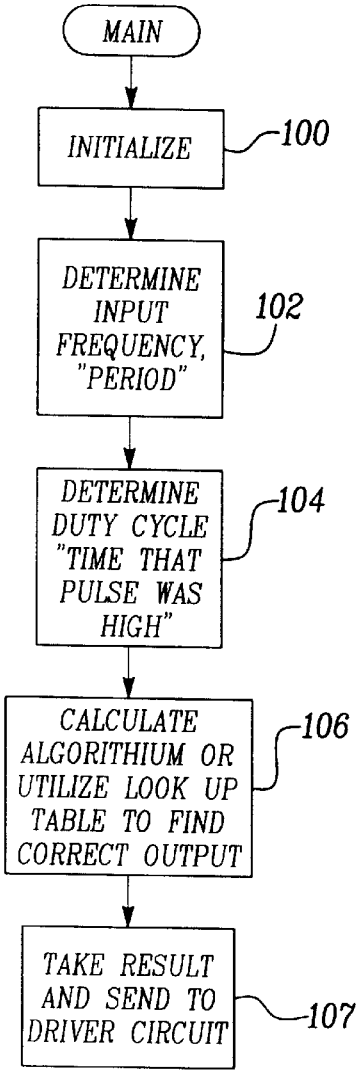
FIG. 4 is a flow chart of the method according to FIG. 3 for controlling the solenoid.

Turning now to FIG. 4, a flow chart showing operation of the microprocessor 80 is shown. The first and second input signals 82, 84 each trigger an interrupt in the microprocessor 80. Another means to obtain the pulse width and period is to poll the input pin on the microprocessor 80. The microprocessor 80 operates as follows. First, the microprocessor 80 is initialized, as set forth in step 100, wherein the counters are all reset and checked and the program is ready to operate. The next step is to determine the frequency of the input signal 102. Next, the duty cycle is determined 104. Once the duty cycle is determined 104, a look up table or algorithm is used to determine the correct output signal 106. The frequency of the output signal calculated in step 106 either through an algorithm or a look up table is empirically developed to reach or arrive at a particular flow profile designed for use with a particular vehicle operating parameters. The next step 107 is to take the output obtained in step 106 and send it through output pin 86 to the driver circuit 90.

Figure 6:
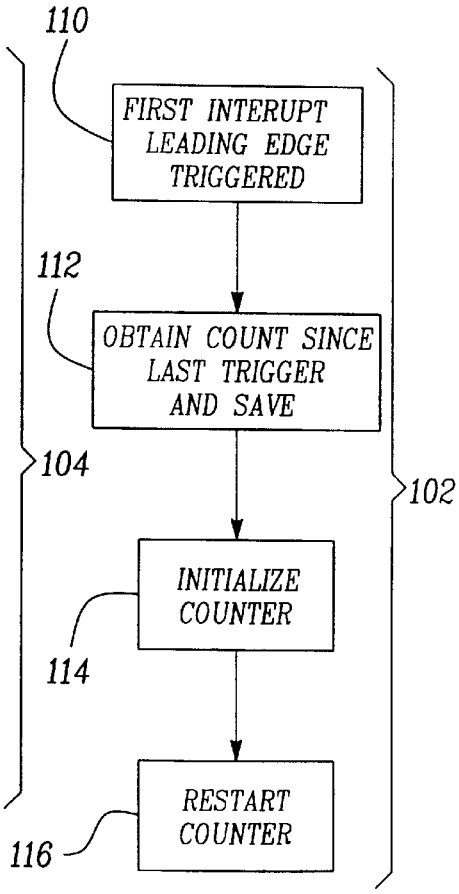
FIG. 6 is a flow chart of the method according to FIG. 4 illustrating a method to determine the input frequency.

Turning now to FIG. 6, a flow chart illustrating how to determine the frequency of the input signal 102 is shown. Initially, the first step 110 is that the input signal 82 triggers a first interrupt. The first interrupt is triggered by the leading edge of the duty cycle wave of the duty cycle input 30. The next step 112 is to obtain a count since the last trigger event. The count is then saved in a register as the period. As known, the period is the time between rising edges of the wave form of the duty cycle input 30. After saving the count, the next step 114 is to reinitialize the counter in order to obtain a new count. The next step 116 is to restart the counter upon the next trigger of the first interrupt indicating it has been triggered by a leading edge of a wave form representing the duty cycle in the duty cycle input 30.

Figure 5:
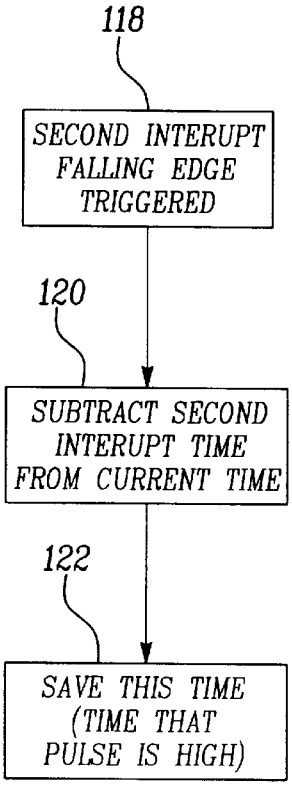
FIG. 5 is a flow chart of the method according to FIG. 4 illustrating a method to determine the duty cycle.

Turning now to FIG. 5, a flow chart representing the determination of the duty cycle of the input signal 104 is shown. Initially, the first step 118 is that the second input signal 84 is received at a second interrupt which is triggered by the falling edge of the wave form representing duty cycle input 30. The counter stops when the first interrupt is retriggered, see step 110 of FIG. 6. The next step 120 is to subtract the second interrupt from the current time that is the time since the first interrupt was triggered. The next step 122 is to save the result in a register as the time the pulse is high. The time the pulse is high corresponds to the duty cycle input 30.

Figure 8:
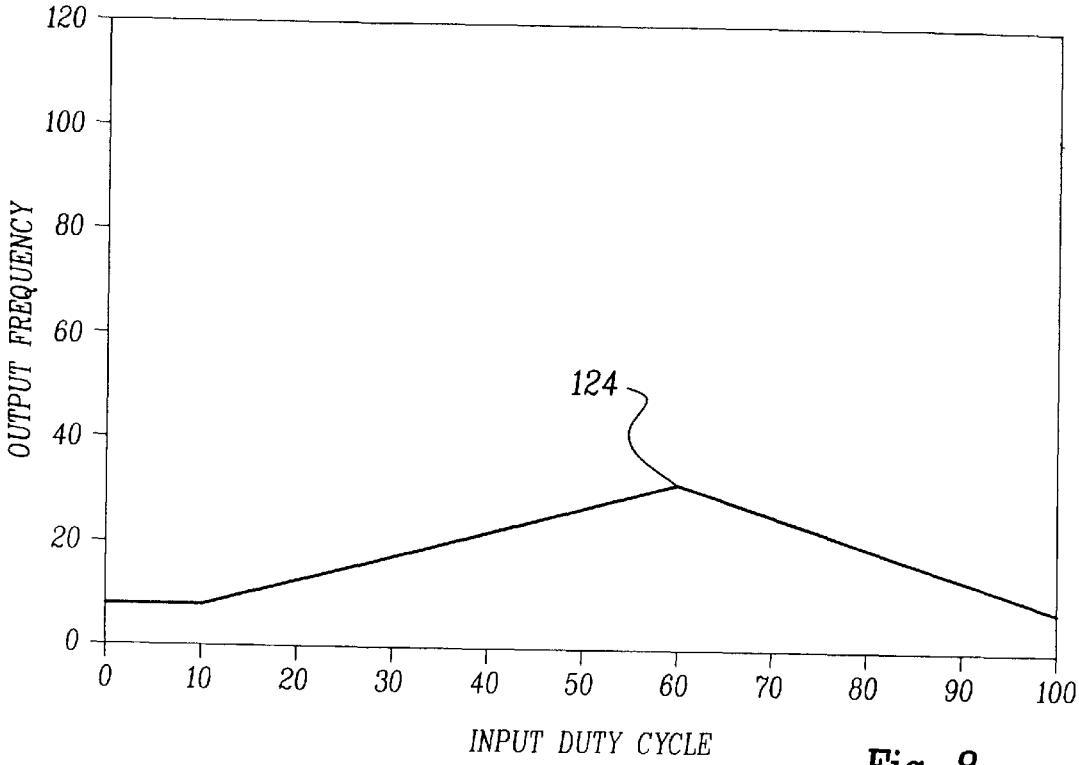
FIG. 8 illustrates a graphical representation of the output frequency compared to the input duty cycle.

As set forth above, The frequencies of the output signal 88 at output pin 86 varies depending upon the percent duty cycle input used. For example, as shown in FIG. 7, the frequency of the output signal 88 at output pin 86 will vary with the percent duty cycle of the duty cycle input 30. FIG. 7 is an example of a look up chart representing varying output signals based on an input signal at constant 16 hertz frequency and a variable percent duty cycle. This table could also be used with a flow requirement input rather than a variable percent duty cycle as the output gives the correct percent duty cycle and frequency. As shown in FIG. 7, as the percent duty cycle changes, the frequency of the output signal varies. FIG. 8 shows the values of FIG. 7 in graphic form. As the percent duty cycle varies, the frequency increases until it reaches a high point 124 of 32 hertz at a 60 percent duty cycle. Upon reaching a 60 percent duty cycle, the frequency then decreases as the duty cycle continues to increase. It should be appreciated that the percent duty cycle that defines the inflection point, i.e., the point at which the slope changes, can be varied according to desirable operating parameters or characteristics. While the frequency varies, the duty cycle of the output signal remains the same as that of the input signal. Rather than use a look up chart as shown in FIG. 7, it is also possible to have an algorithm that calculates the output frequency based upon a given input duty cycle. The algorithm is developed to arrive at a particular flow curve such as that shown in FIG. 9. The next step is to take the output signal 88 generated at output pin 86 and send it to the driver circuit 90. The driver circuit 90 boosts the output signal 88 into the control signal 92 used to control the solenoid valve 26.

Figure 9:
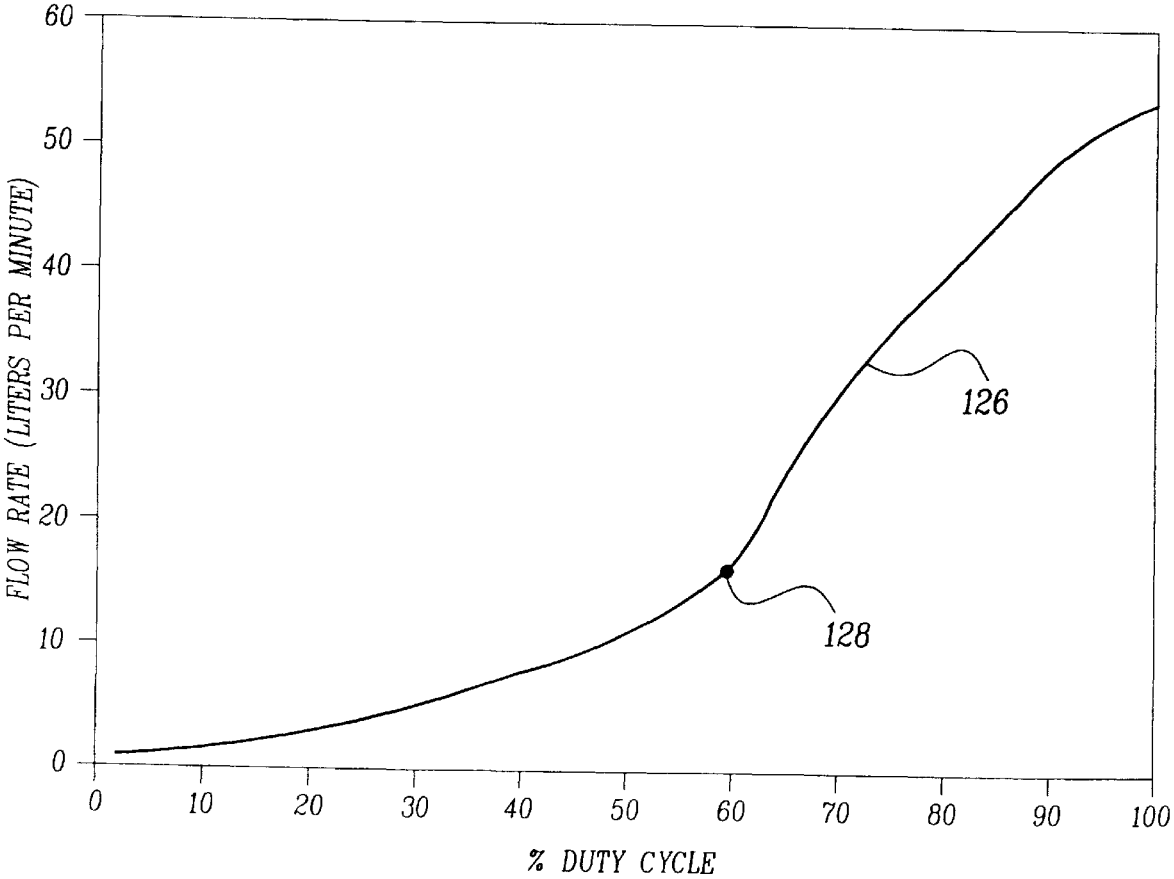
FIG. 9 illustrates a graphical representation of the flow rate compared to the input duty cycle.

As set forth above, the present invention varies the frequency of the duty cycle input 30 at a particular percent duty cycle to control the operation of the solenoid valve 26 during changes in the duty cycle input 30. Varying the frequency allows the slope of the flow curve change relative to changes in the duty cycle. Thus, variable rates of flow versus percent duty cycle of fuel vapor from the canister can be achieved. As shown in FIG. 9, the slope of various sections of the flow rate curve 126 change relative to the percent duty cycle. Thus, the control circuit of the present invention enables a simple or single passage solenoid valve to have a multi-slope flow profile. For instance, as shown in FIG. 9, the flow rate varies from 0 liters per minute to 16 liters per minute as the duty cycle changes from 0 to 60 percent, see point 128. However, as the duty cycle changes from 60 to 100 percent, the flow rate jumps from 16 liters per minute to 54 liters per minute. Such a flow profile allows greater or improved flow control in the low end of the duty cycle and an increased flow rate at the high end of the duty cycle.

It should be appreciated that the frequency of the output signal is varied depending upon the duty cycle input 30 or input flow desired to arrive at a multitude of flow profiles depending upon the profile desired for use with a particular vapor control system. Thus, control systems, as set forth above, allow the use of a single passage solenoid valve to generate multiple slope flow paths.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the invention may be practiced other than as specifically described.

I claim:

1. A method of controlling a solenoid to obtain a desired flow rate including the steps of:

receiving a signal representing the desired solenoid flow rate;

generating an output signal, including a frequency component and a percent duty cycle component, based on the desired flow rate by varying said frequency component with said percent duty cycle component; and using said output signal to control operation of said solenoid.

2. A method of controlling a solenoid as set forth in claim 1 wherein the step of generating an output signal includes the steps of determining said percent duty cycle component; using a look up table and said percent duty cycle component to select a said frequency component at which said output signal is generated; and combining said percent duty cycle component with the selected frequency component to form said output signal.

3. A method of controlling a solenoid as set forth in claim 1 wherein the step of generating an output signal includes the steps of determining said percent duty cycle component; using an algorithm in conjunction with said percent duty cycle component to determine said frequency component at which said output signal is generated; and combining said percent duty cycle component with said frequency component to form said output signal.

4. A method for controlling a solenoid comprising the steps of:

receiving an input signal representing a duty cycle;

determining a frequency of said input signal;

determining a duty cycle of said input signal;

generating an output signal based on said input signal, said output signal having an output signal frequency such that the output signal frequency varies depending on changes in said duty cycle of said input signal; and controlling operation of the solenoid based on said output signal.

5. A method for controlling a solenoid as set forth in claim 4 wherein the step of generating an output signal includes the step of using a look up table to determine said output signal frequency based on said duty cycle of said input signal.

6. A method for controlling a solenoid as set forth in claim 4 wherein the step of generating an output signal includes the step of using an algorithm to calculate said output signal frequency based on said duty cycle of said input signal.

7. A method for controlling a solenoid as set forth in claim 4 wherein the step of determining said frequency of said input signal includes providing a microprocessor, said microprocessor receiving said input signal;

providing a first interrupt, said first interrupt detecting a leading edge of said duty cycle of said input signal;

determining a period between successive first interrupts caused by successive leading edges of said duty cycle; and saving said period in a register of said microprocessor, said period representing the period of said input signal.

8. A method for controlling a solenoid as set forth in claim 4 wherein the step of determining said duty cycle of said input signal includes the steps of:

providing a microprocessor including a counter, said microprocessor receiving said input signal;

providing a second interrupt, said second interrupt interrupting said counter detecting a falling edge of said duty cycle of said input signal; and using said detection of said falling edge of said duty cycle of said input signal to determine said duty cycle of said input signal.

9. A method for controlling a solenoid as set forth in claim 4 wherein the step of controlling the operation of said solenoid based on said output signal includes the step of boosting said output signal and using the boosted output signal to control the solenoid.

10. A method for controlling a solenoid comprising the steps of:

obtaining a signal representing a duty cycle determined from a variety of operating parameters;

generating an output signal based on said signal representing said duty cycle, said output signal having a frequency wherein said frequency is dependent on said duty cycle;

calculating the frequency of said output signal dependent on said duty cycle; and using said output signal to control the operation of the solenoid valve.

11. A method for controlling a solenoid as set forth in claim 10 wherein the step of calculating the frequency of said input signal dependent on said duty cycle includes the steps of determining said duty cycle; using a look-up table and said duty cycle to determine an output signal frequency; and combining said duty cycle with said output signal frequency to form said output signal.

12. A method of controlling a solenoid as set forth in claim 10 wherein the step calculating the frequency of said input signal dependent on said duty cycle includes the steps of determining the duty cycle; using an algorithm and said duty cycle to determine an output signal frequency; and combining the duty cycle with said output signal frequency to form said output signal.

13. A method for controlling the operation of a solenoid comprising the steps of:

receiving an input signal representing a duty cycle in the form of a pulse wherein the width of said pulse represents a percentage of said duty cycle;

generating a voltage level directly proportional to the width of said pulse;

establishing a reference voltage;

comparing the generated voltage to the reference voltage and developing a logic output based on said comparison;

generating an output signal, said output signal having an output signal frequency based on the logic output and the generated voltage; and utilizing said output signal to control the solenoid valve.

14. A method for controlling the operation of a solenoid as set forth in claim 13 wherein said output signal frequency is proportional to the generated voltage level.

15. A method for controlling the operation of a solenoid as set forth in claim 13 wherein the step of generating an output signal includes the step of combining said duty cycle with said output signal frequency.

16. A method for controlling the operation of a solenoid as set forth in claim 13 wherein the step of establishing a reference voltage includes the step of determining a voltage level corresponding to a percentage of the input signal representing a duty cycle and storing said voltage level as said reference voltage.

17. A method for controlling the operation of a solenoid as set forth in claim 13 wherein said step of comparing the generated voltage to the reference voltage and developing a logic output based on said comparison includes the steps of generating a first logic output when said reference voltage is higher than said generated voltage and generating a second logic output when said reference voltage is lower than said generated voltage.

18. A method for controlling the operation of a solenoid as set forth in claim 17 including the step of varying said output signal frequency proportional to said generated voltage when said first logic signal output is generated and varying said output signal frequency inversely proportional to the generated voltage when said second logic output is generated.

19. A method for controlling the operation of a solenoid as set forth in claim 17 wherein said step of generating an output signal based on said logic output includes the steps of increasing the voltage of said output signal proportional to the generated voltage when the first logic output is generated and decreasing the voltage of said output signal inversely proportional to said generated voltage when the second logic output is generated; and driving an astable oscillator with said output signal to produce an output signal frequency proportional to the voltage of said output signal.

20. A method for controlling the operation of a solenoid as set forth in claim 19 including the step of combining said duty cycle with said output signal frequency.

21. A controller for controlling operation of a solenoid comprising:

a clipper, said clipper receiving an input signal in the form of a pulse corresponding to a particular duty cycle and generating an output pulse at a predictable peak voltage;

an integrator receiving said output pulse and generating an integrator output signal having a voltage proportional to the width of said pulse at said predictable peak voltage;

a comparator receiving said integrator output signal from said integrator and comparing said integrator output signal to a reference voltage and generating a comparator output based on the comparison;

a signal conditioner receiving the comparator output generated by said comparator and generating a conditioned output signal, said conditioned output signal proportional to said integrator output signal when said comparator output is a 0 and is inversely proportional when said comparator output is a 1;

an astable oscillator receiving said conditioned output signal and producing an oscillator signal having a frequency proportional to said conditioned output signal; and a monostable oscillator receiving said oscillator signal and combining said oscillator signal and said duty cycle of said input signal to generate a control signal that controls operation of the solenoid.

22. An apparatus as set forth in claim 21 wherein said reference voltage is set at a value equal to a voltage level determined by said integrator when said input signal represents a 60 percent duty cycle.

23. An apparatus as set forth in claim 21 including a voltage supply to supply power to the controller.

24. An apparatus as set forth in claim 23 including a regulator connected to said voltage supply.

25. A method of controlling a solenoid including the steps of:

obtaining a signal representing a duty cycle or desired flow determined from a variety of operating parameters;

generating an output signal based on said signal representing said duty cycle or desired flow, said output signal having a frequency wherein said frequency is varied dependent on said duty cycle or desired flow; and using said output signal to control the operation of the solenoid valve.

26. A method of controlling a solenoid as set forth in claim 25 wherein the step of generating an output signal based on said input signal representing said duty cycle or said desired flow includes the steps of determining said duty cycle; using a look up table and said duty cycle or said desired flow to select a frequency at which said output signal is generated; and combining said duty cycle or said desired flow with the selected frequency to form said output signal.

27. A method of controlling a solenoid as set forth in claim 25 wherein the step of generating an output signal based on said input signal representing said duty cycle or said desired flow includes the steps of determining said duty cycle or said desired flow; using an algorithm in conjunction with said duty cycle or said desired flow to determine a frequency at which said output signal is generated; and combining said duty cycle or said desired flow with said frequency to form said output signal.

* * * * *